United States Patent [19]

Ogawa et al.

[11] Patent Number: 4,587,725

[45] Date of Patent: May 13, 1986

[54] TERMINAL CRIMPING APPARATUS

[75] Inventors: Yukihiko Ogawa; Saburo Kusumi, both of Komaki; Michio Fukuda; Toshifumi Okunishi, both of Osaka; Sinkichi Miwa; Yosinobu Ohta, both of Yokkaichi, all of Japan

[73] Assignees: CKD Corporation; Sumitomo Electric Industries, Ltd.; Tokai Electric Wire Co., Ltd., all of Japan

[21] Appl. No.: 635,435

[22] Filed: Jul. 30, 1984

[30] Foreign Application Priority Data

Aug. 9, 1983 [JP] Japan ..... 58-123500[U]

[51] Int. Cl.[4] ..... H01R 43/04

[52] U.S. Cl. ..... 29/753; 72/441; 92/13.7; 100/257

[58] Field of Search ..... 29/753, 751, 566.2, 29/566.3; 72/441; 100/257; 92/13.7, 13.1

[56] References Cited

U.S. PATENT DOCUMENTS 3,051,213 8/1962 Batcheller ..... 29/753 X 3,889,515 6/1975 Gvombka ..... 100/257 X 4,025,999 5/1977 Wolyn et al. ..... 29/753

4,433,476 2/1984 Bailey et al. ..... 29/752

*Primary Examiner*—Carl E. Hall

*Attorney, Agent, or Firm*—Ernest A. Beutler

[57] ABSTRACT

An apparatus for automatically crimping terminals to electric wires by a cooperation between a pressing punch driven through a press ram and a stationary anvil. The apparatus has a crimp height adjusting mechanism which includes a tapered spacer movable perpendicularly to the press ram, a stopper member having a complementary tapered surface and slidably placed on the tapered spacer so as to be able to move only vertically as the tapered spacer is moved. The stopper member has an upper surface adapted to be contacted by a portion of the press ram thereby determining the stroke end of the press ram. The tapered spacer is slidingly moved in a controlled manner by an electric motor, so that the heightwise position of the stopper member is changed to allow a delicate adjustment of the lower stroke end of the press ram. In consequence, the crimp height is automatically adjusted minutely in accordance with the diameter of the electric wire to be processed.

6 Claims, 3 Drawing Figures

TERMINAL CRIMPING APPARATUS

BACKGROUND OF THE INVENTION

The present invention relates to an improvement in a terminal crimping apparatus for crimping terminals automatically and consecutively to the ends of electric wires.

A typical known terminal crimping apparatus has a pressing punch attached to the lower end of a press ram and an anvil disposed below the press ram. In operation, electric wires and terminals are supplied consecutively onto the anvil and the pressing punch is repeatedly driven downwardly thereby to automatically and consecutively crimp the terminals to the ends of the electric wires. This known crimping apparatus, however, suffers from the following disadvantage. In most cases, the diameter of the electric wire, as well as the size and shape of the terminal, varies depending on the uses, so that the crimp height, i.e., the height of the terminal crimped on the electric wire from the surface of the anvil, varies widely. The known crimping apparatus of the type explained before, however, is intended for the crimping of the terminals of an equal size and shape to electric wires of a given diameter. Namely, it is necessary to take trouble of accurately measuring the final crimp height and precisely adjusting the lower stroke end of the pressing punch, in the preparatory step each time the diameter of the electric wire is changed.

In consequence, the man-hour in the preparatory step is increased undesirably.

In the modern automatic system, a series of operation including cutting of electric wire, stripping, twisting of the stripped conductor and crimping of a terminal, is conducted by a continuous line. Such an automatic system is often required to cope with a demand for a large-lot and small-quantity production. With the known crimping apparatus of the type described, it is quite difficult to cope with such a demand.

SUMMARY OF THE INVENTION

Accordingly, an object of the invention is to provide a novel crimping apparatus which can crimp terminals to electric wires in a good condition even if the crimp height is varied in successive crimping cycles.

To this end, according to the invention, there is provided a crimping apparatus for crimping a terminal to the end of an electric wire comprising: a press ram provided at its lower end with a pressing die; an anvil disposed stationarily to oppose to the pressing die; means for successively supplying terminals onto the anvil; means for feeding electric wires into the terminal on the anvil; means for actuating the press ram against the anvil thereby to crimp the terminal to the end of the electric wire; and crimp height adjusting means adapted to determine the crimping stroke end of the ram.

These and other objects, features and advantages of the invention will become clear from the following description of the preferred embodiments taken in conjunction with the accompanying drawings.

DESCRIPTION OF THE PREFERRED EMBODIMENTS

Figure 1:
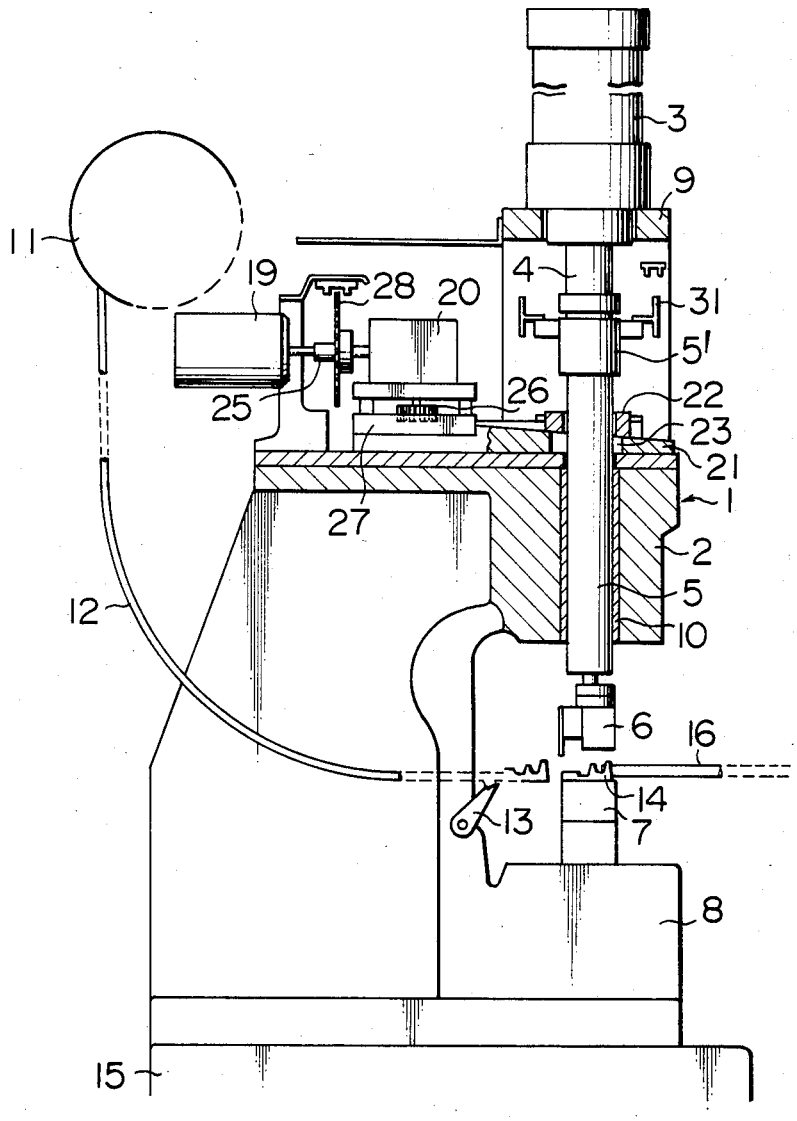
FIG. 1 is a side elevational view of an embodiment of the terminal crimping apparatus in accordance with the invention.
Figure 2:
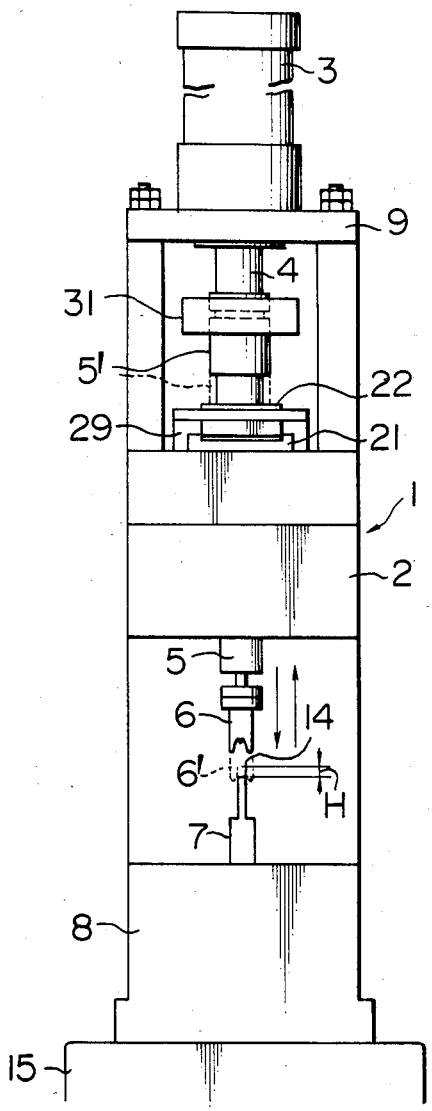
FIG. 2 is a front elevational view of the crimping apparatus shown in FIG. 1.
Figure 3:
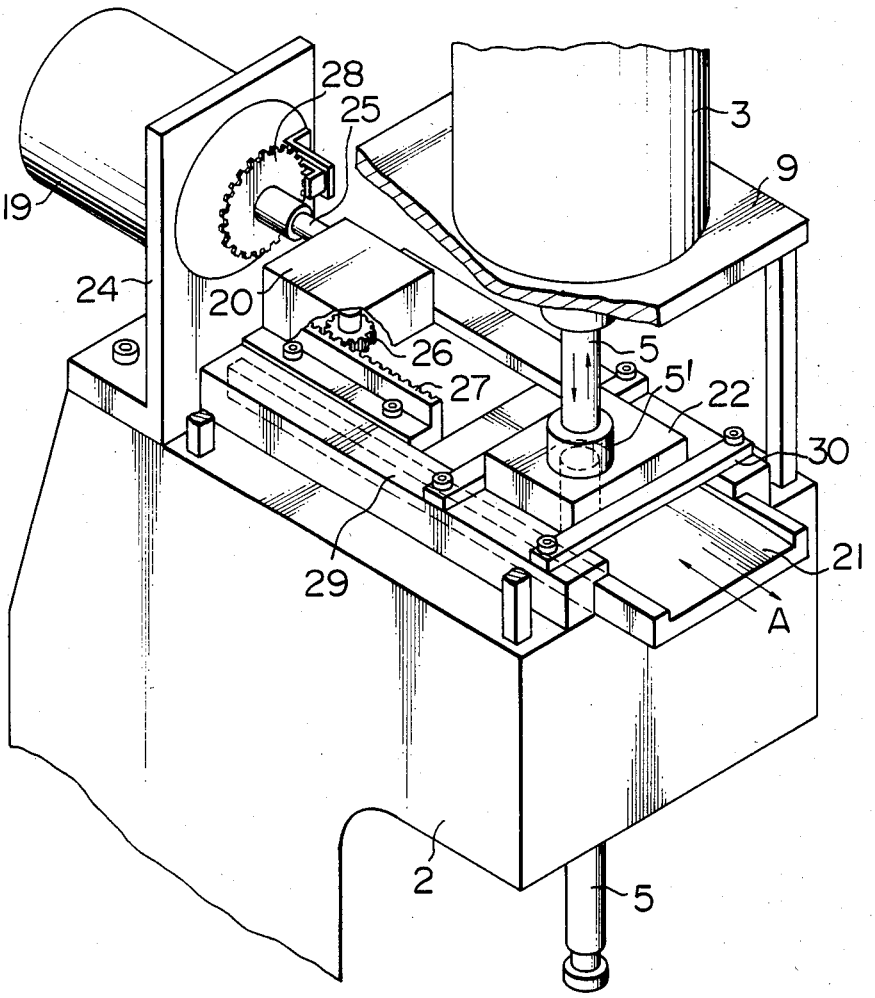
FIG. 3 is a perspective view of a crimp height adjusting mechanism.

Referring first to FIGS. 1 to 3, a terminal crimping apparatus 1 of the invention has a frame 2 carrying a column 9 which in turn mounts a hydraulic cylinder 3 directed downwardly. The hydraulic cylinder 3 has a rod 4 to which connected is a press ram 5. The press ram 5 is adapted to be moved up and down along the guide surface 10 on the frame 2. A pressing punch 6 which is known per se is attached to the lower end of the press ram 5. On the other hand, an anvil 7 which serves as a lower die for cooperating with the pressing punch 6 is mounted on a base 8 so as to oppose to the pressing punch 6. A terminal chain reel 11 having terminals connected in the form of a chain or a belt is mounted on the rear upper portion of the crimping apparatus. The terminals 14 connected in the form of a chain is fed onto the anvil 7 in a one-by-one fashion by a feeding claw 13 disposed at one end of a terminal chain guide 12 connected to the terminal chain reel 11. On the other hand, an electric wire 16 to which the terminal 14 is to be crimped is successively fed by a suitable feeding means. The feed of the electric wire 16 is made in such a manner that the end of the wire 16 is inserted into the terminal 14 on the anvil. Then, the pressing punch 6 is lowered to press the crimping portion of the terminal 14 thereby to crimp the terminal 14 to the electric wire. This operation is repeated to crimp the terminals 14 onto the ends of electric wires 16 which are fed successively.

According to the invention, the terminal crimping apparatus 1 is provided with a crimp height adjusting mechanism which will be explained hereinbelow. Referring to FIGS. 1 and 3, the frame 2 carries a tapered spacer 21 perpendicular to the press ram 5 and adapted to move in the back and forth direction, i.e., to the left and right as viewed in FIG. 1. The tapered spacer 21 has a tapered surface the heigth of which is progressively decreased from the front to rear end thereof at a small gradient. The aforementioned press ram 5 is received by a bore 23 formed in the front half part of the tapered spacer 21. A stopper member 22 is provided with a tapered back surface which is tapered in the direction opposite to the tapered surface of the tapered spacer 21 at the same gradient with the latter. The stopper member 22 rests on the tapered surface of the tapered spacer 21 and is provided at its central portion with a hole for receiving the press ram 5. The arrangement is such that, when the press ram 5 is moved downwardly, the upper end of the stopper member 22 is contacted by the lower end of a boss 5' of the press ram 5, thus determining the lower stroke end of the press ram 5. It will be seen that the lower stroke end can be adjusted freely by sliding the tapered spacer 21 due to the mutual contact of the tapered surfaces of the stopper member 22 and the tapered spacer 21.

The sliding of the tapered spacer 21 is effected by the following arrangement. An electric motor 19 is carried by a bracket 24 provided on a rear upper portion of the frame 2. A speed reducer 20 mounted on the frame 2 is connected to the rotor shaft 25 of the electric motor 19. The speed reducer 20 is provided at its output side with a pinion 26 which engages with a rack 27 provided on a rear upper portion of the tapered spacer 21. Consequently, the tapered spacer 21 is slided back and forth in the direction of the arrow A as the electric motor 19 operates. In order to correctly control the sliding stroke of the tapered spacer 21, an A.C. motor or a servo motor is used as the electric motor 19, and an optical sensor 28 is attached to the rotor shaft 25 of the electric motor 19. Namely, the amount or stroke of the sliding movement of the tapered spacer 21 is controlled by a control circuit which is adapted to control the number of forward or backward rotations of the rotor shaft 25 which is sensed in the form of pulses counted by the sensor 28.

The sliding movement of the tapered spacer 21 is smoothed by a pair of guide grooves 29 which slidingly receive corresponding side edges of the tapered spacer 21. The lateral movement of the stopper member 22 is prevented by the members in which the guide grooves 29 are formed, while the movement of the same in the back and forth direction is prevented by holding frames 30 which bridge the above-mentioned members. Thus, the stopper member 22 is allowed to move only in the vertical direction by the wedging action of the tapered spacer 21. A reference numeral 31 designates a sensor for confirming the upper and lower stroke ends of the press ram 5.

The terminal crimping apparatus having the described construction operates in a manner explained hereinunder.

Namely, as an instruction representing a new crimp height is given, the electric motor 19 operates to drive the spacer 21 forwardly or backwardly so that the stopper member 22 is moved upwardly or downwardly. The vertical position of the stopper member 22 is thus adjusted minutely. The stopper member 22 is contacted by the boss portion 5' of the press ram 5 moving downwardly, thus determining the downward stroke end of the press ram 5, i.e., the distance H between the pressing punch 6' and the anvil 7 as shown in FIG. 2. This crimp height is exactly the same as that instructed by the control circuit. Namely, the amount of rotation of the rotor shaft 25 of the electric motor 19, which determines the amount of the sliding movement of the tapered spacer 21 and, hence, the crimp height, is precisely controlled partly because the amount of rotation is fed back by the sensor 28 which detects the number of pulses corresponding to the rotation amount of the rotor shaft 25 and partly because the rotation amount is transmitted to the tapered spacer through the intermediary of the speed reducer 20. In addition, the reactional thrust produced by the impacting contact of the press ram 5 with the stopper member 22 is safely born by the speed reducer 20 so that the tapered spacer can be held correctly at the aimed position. Furthermore, the vertical height of the stopper member 22 can be adjusted minutely thanks to the wedging action of the tapered spacer 21, thereby permitting a delicate adjustment of the lower stroke end of the press ram 5, i.e., the crimp height.

Data concerning the crimp heights for successive electric wires having different diameters are inputted beforehand in the control circuit, so that the slide of the tapered spacer 21 is adjusted to provide the desired crimp height for each crimping cycle. Consequently, the crimping apparatus of the invention can be used conveniently in the large-lot and small-quantity production of electric wires having crimped terminals, not to mention to a mass production of wires with crimped terminals having of the same size and shape.

Although the invention has been described through specific terms, it is to be noted here that the described embodiment is not exclusive and various changes and modifications may be imparted thereto without departing from the scope of the invention which is limited solely by the appended claims.

What is claimed is:

1. A crimping apparatus for crimping a terminal to the end of an electric wire comprising a reciprocating press ram provided at its lower end with a pressing die, an anvil disposed stationarily in opposition to said pressing die means for successively supplying terminals onto said anvil; means for feeding electric wires into the terminal on said anvil, means for actuating said press ram against said anvil thereby to crimp said terminal to the end of said electric wire, and crimp height adjusting means positioned to be engaged by said press ram during its stroke for limiting the stroke of said ram, and, hence, the crimp height, said crimp height adjusting means comprising a tapered spacer disposed perpendicularly to said press ram and provided with a tapered upper surface, a stopper member having a tapered lower surface and having an upper surface positioned to be contacted by said press ram, and a driving means for slidingly driving said tapered spacer in a direction perpendicular to said press ram to determine the crimping stroke of said ram.

2. A crimping apparatus according to claim 1, wherein said driving means includes an electric motor and a speed reducer for transmitting the power of said electric motor to said tapered spacer.

3. A crimping apparatus according to claim 2, further comprising control means for controlling the operation of said electric motor and a feedback means for feeding back the amount of rotation of the motor shaft to said control means.

4. A crimping apparatus according to claim 1, wherein the stopper member and the tapered spacer each have openings formed therein for passing the press ram.

5. A crimping apparatus according to claim 4, wherein said driving means includes an electric motor and a speed reducer for transmitting the power of said electric motor to said tapered spacer.

6. A crimping apparatus according to claim 5, further comprising control means for controlling the operation of said electric motor and a feedback means for feeding back the amount of rotation of the motor shaft to said control means.

* * * * *